US007014602B2

(12) United States Patent
Yamauchi

(10) Patent No.: US 7,014,602 B2
(45) Date of Patent: Mar. 21, 2006

(54) LEG STRETCHING APPARATUS

(76) Inventor: Ken J. Yamauchi, 5627 Cowell Blvd., Davis, CA (US) 95616

( * ) Notice: Subject to any disclaimer, the term of this patent is extended or adjusted under 35 U.S.C. 154(b) by 35 days.

(21) Appl. No.: 10/613,649

(22) Filed: Jul. 3, 2003

(65) Prior Publication Data

US 2005/0003935 A1 Jan. 6, 2005

(51) Int. Cl.
*A63B 26/00* (2006.01)

(52) U.S. Cl. ..... 482/142; 482/79

(58) Field of Classification Search ..... 482/142, 482/79, 148, 80, 907, 72, 91
See application file for complete search history.

(56) References Cited

U.S. PATENT DOCUMENTS

| | | | | |
|---|---|---|---|---|
| 3,834,694 | A | 9/1974 | Pridgen | |
| 4,445,684 | A * | 5/1984 | Ruff | 482/131 |
| 4,456,247 | A | 6/1984 | Ehrenfried | 272/126 |
| 4,456,249 | A | 6/1984 | Calabrese | 272/139 |
| 4,647,040 | A | 3/1987 | Ehrenfried | 272/126 |
| 4,834,073 | A * | 5/1989 | Bledsoe et al. | 601/34 |
| 4,844,453 | A | 7/1989 | Hestilow | 272/126 |
| 4,877,239 | A | 10/1989 | Dela Rosa | 272/126 |
| 4,974,830 | A * | 12/1990 | Genovese et al. | 601/29 |
| 5,004,228 | A | 4/1991 | Powers | 272/125 |
| 5,122,106 | A | 6/1992 | Atwood et al. | 482/131 |
| 5,137,504 | A * | 8/1992 | Mangini | 482/131 |
| 5,230,679 | A | 7/1993 | Olsen | 482/91 |
| 5,421,801 | A | 6/1995 | Davies, III et al. | 482/131 |
| 5,460,596 | A | 10/1995 | Brady | 601/35 |
| 5,507,711 | A | 4/1996 | Richardson | 482/112 |
| 5,584,756 | A | 12/1996 | Grapengiser et al. | 482/92 |
| 5,611,770 | A | 3/1997 | Tesch | 601/34 |
| 5,634,873 | A | 6/1997 | Carlstrom | 482/95 |
| 5,662,592 | A | 9/1997 | Brady | 601/34 |
| 5,762,592 | A | 6/1998 | Neveux | 482/131 |
| 5,842,960 | A | 12/1998 | Yu | 482/131 |
| 5,853,354 | A | 12/1998 | Kubota | 482/80 |
| 5,913,759 | A * | 6/1999 | Bostrom | 482/907 |
| 5,984,845 | A | 11/1999 | Powers | 482/148 |
| 6,338,700 | B1 | 1/2002 | Pollock | 482/95 |
| 6,726,600 | B1 * | 4/2004 | Miller | 482/51 |
| 6,764,458 | B1 * | 7/2004 | Polonchek | 602/32 |
| 2004/0152572 | A1 * | 8/2004 | Reitz et al. | |

* cited by examiner

*Primary Examiner*—Gregory L. Huson
*Assistant Examiner*—L. Amerson
(74) *Attorney, Agent, or Firm*—Patent Law Group LLP; David C. Hsia

(57) ABSTRACT

A stretching apparatus includes a base comprising a seat, a back support mounted to the base, at least one leg support pivotally mounted to the base, a first strap securing a user's leg to the leg support, a foot pedal positioned at a free end of the leg support, and a second strap securing a user's heel to the leg support.

27 Claims, 13 Drawing Sheets

Perspective Front View

Control Option

Perspective Back View

Side View

Plan View

Front View

Back View

Foot Paddle - Side View

Foot Paddle - Front View

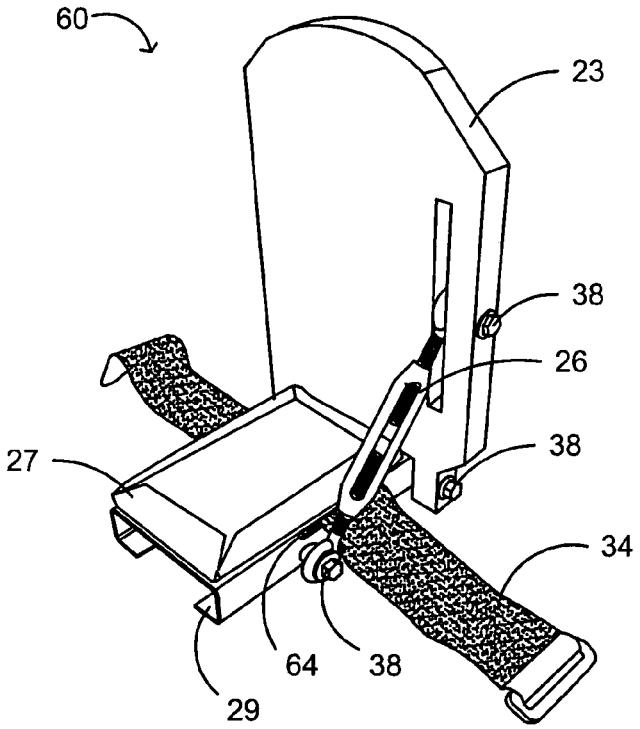
FIG. 10 Sliding Foot Mechanism
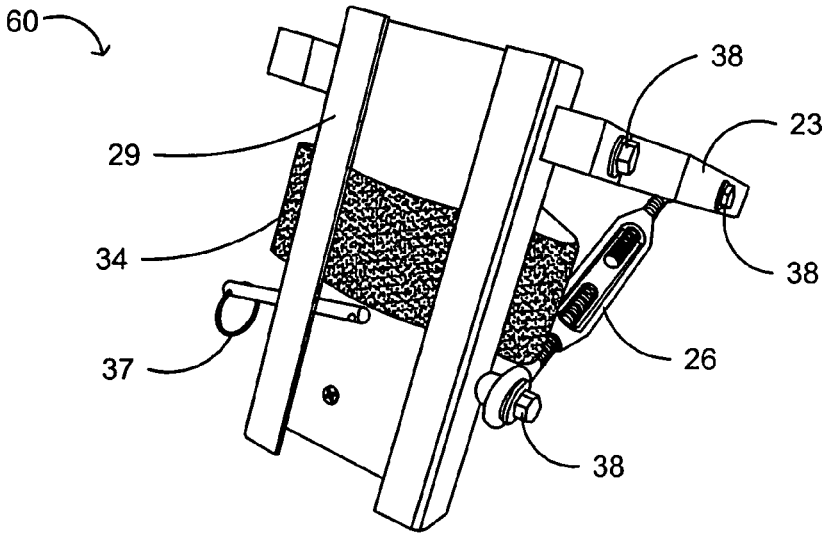
FIG. 11 Bottom View

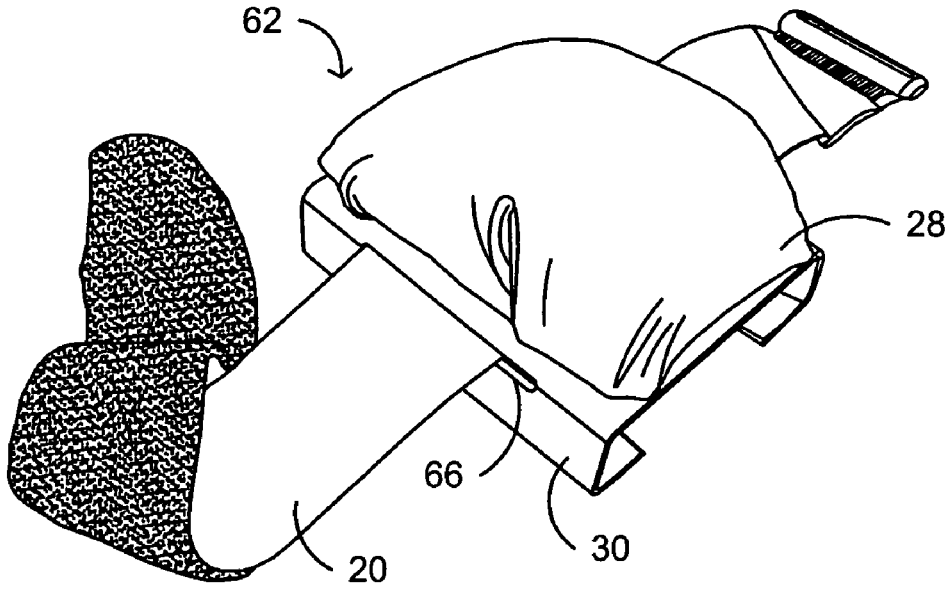
FIG. 12 Sliding Knee Mechanism
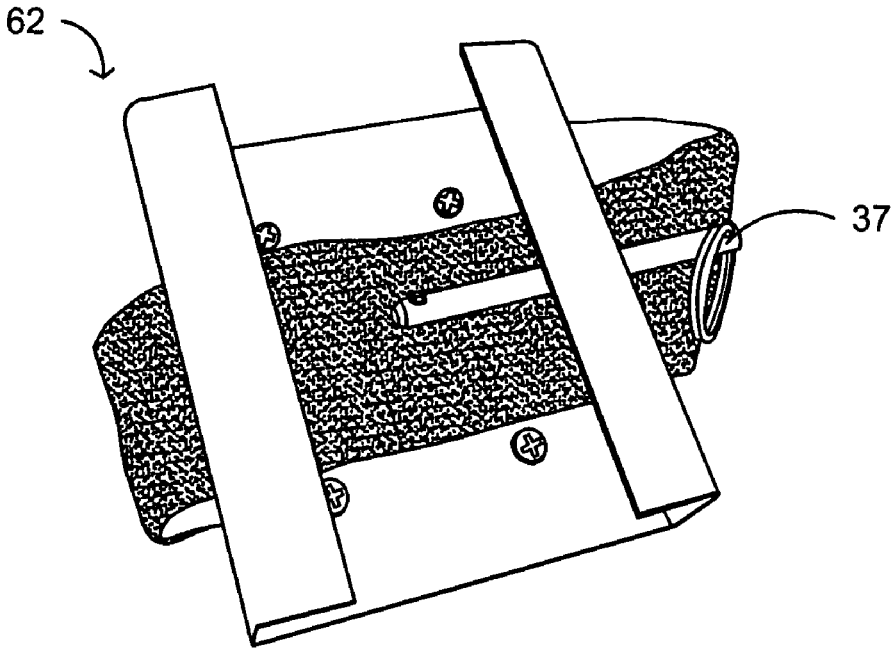
FIG. 13 Bottom View

Sliding Seat Rail

Control Option

Side View - Motion

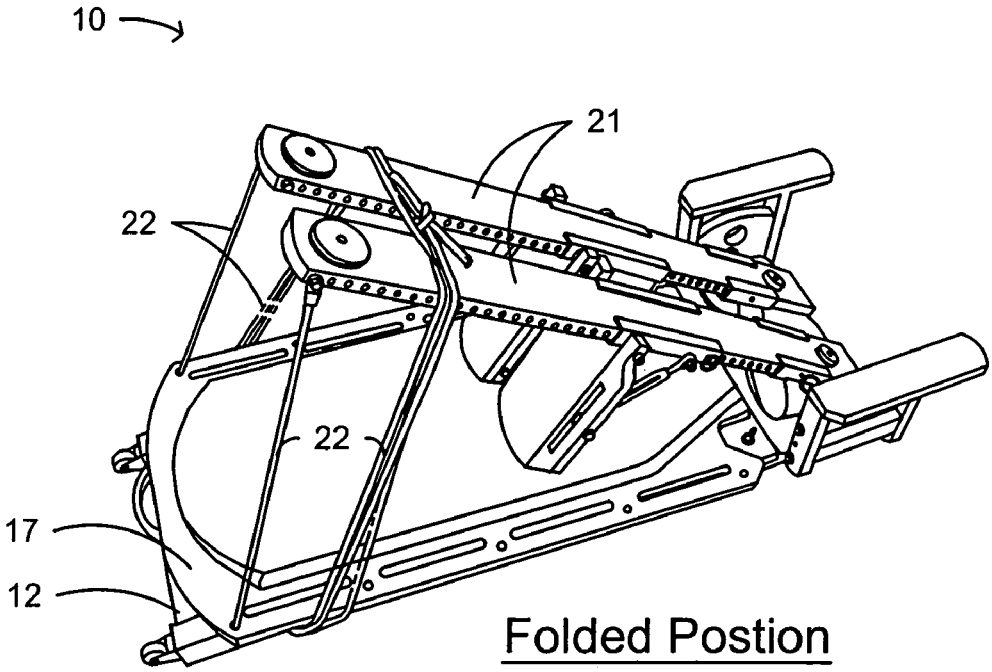
FIG. 17
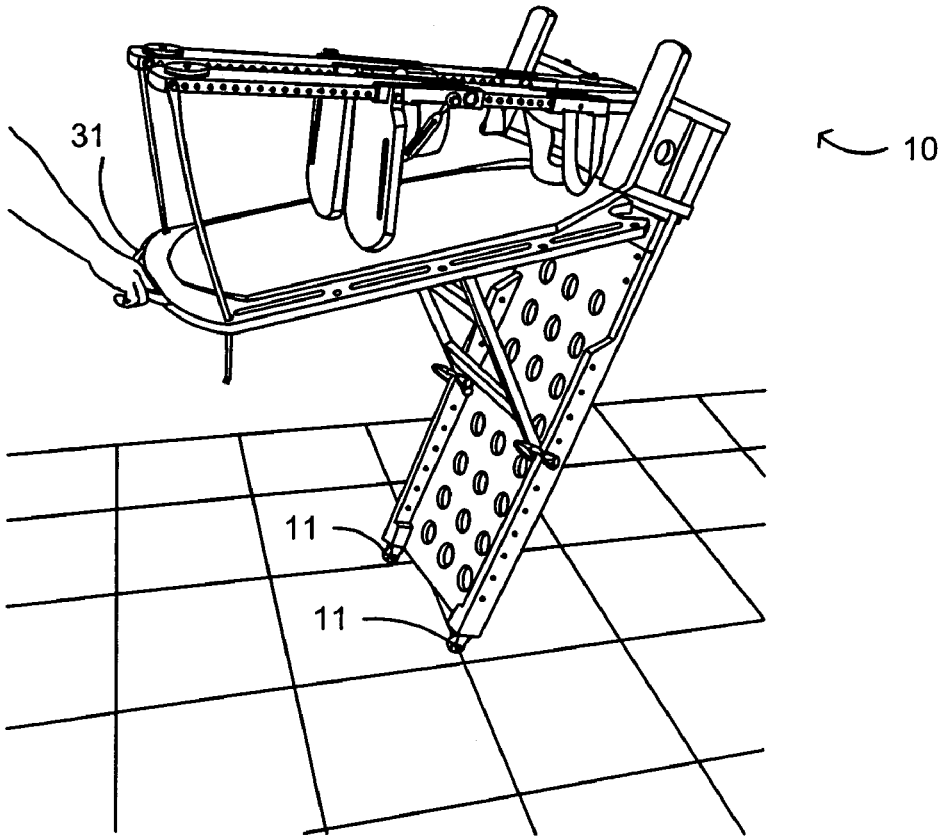
FIG. 18 Moving Position

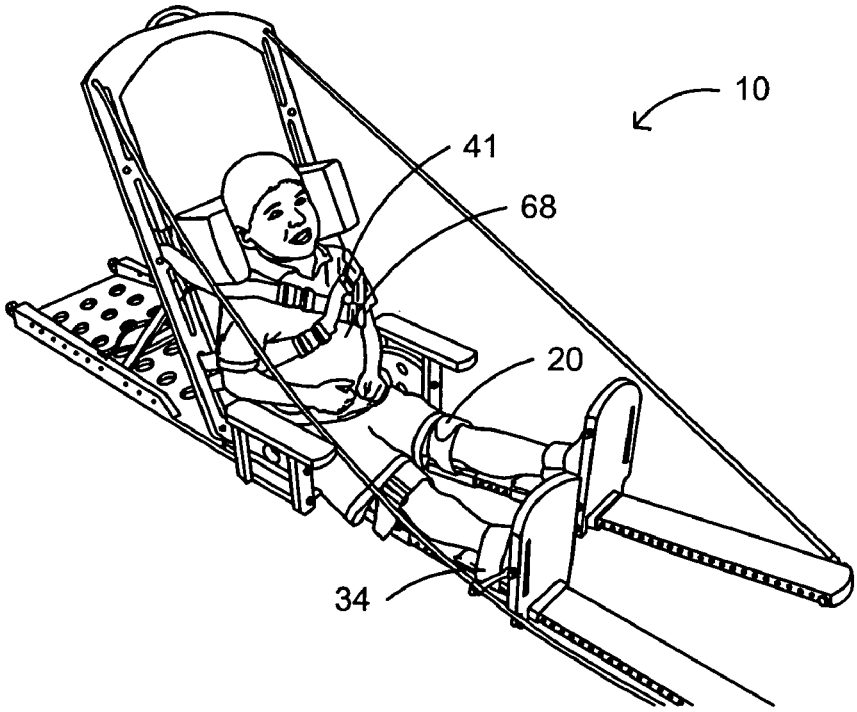
FIG. 19 Stretching Demonstration
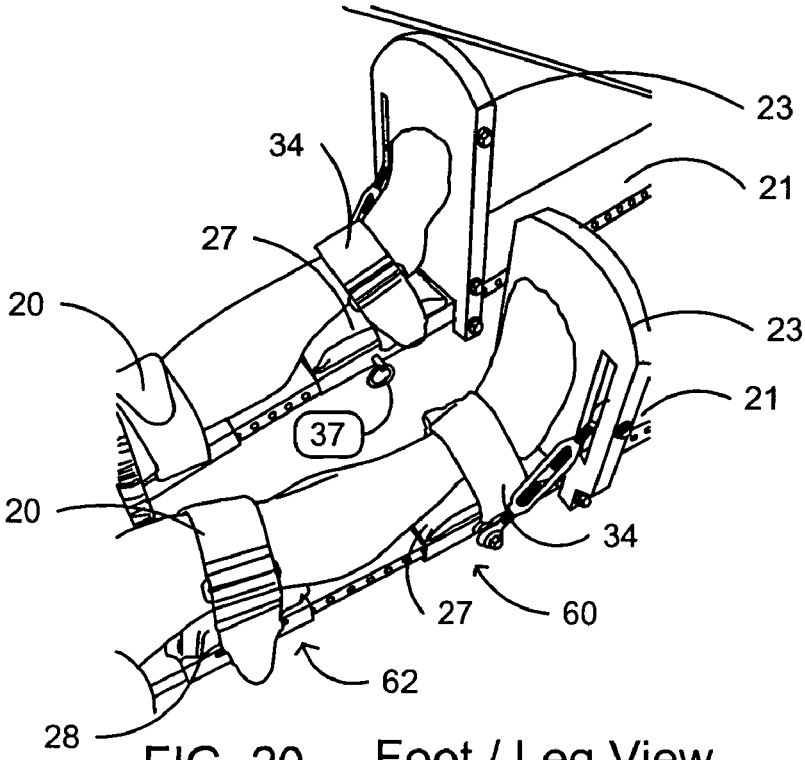
FIG. 20 Foot / Leg View

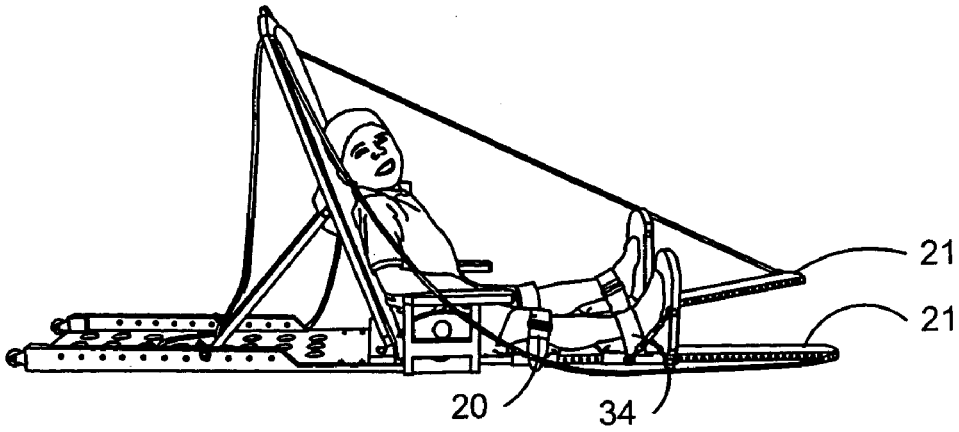
FIG. 21 Slight Recline
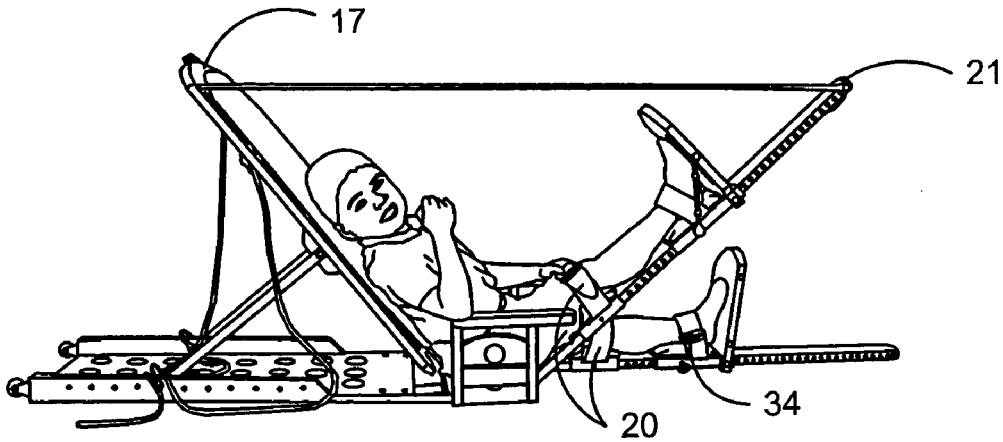
FIG. 22 Mid Recline
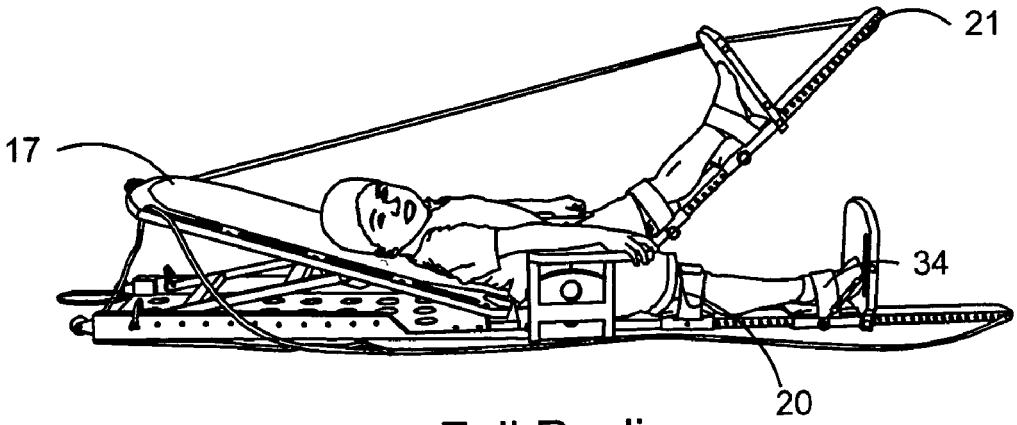
FIG. 23 Full Recline

LEG STRETCHING APPARATUS

FIELD OF INVENTION

This invention relates to a therapeutic apparatus for stretching the leg, specifically the heel cord or Achilles tendon, the calf muscles, and the hamstring muscles plus related muscles, ligaments, and tendons.

DESCRIPTION OF RELATED ART

Duchenne muscular dystrophy (DMD) is a genetic disorder characterized by progressive muscle degeneration. As the muscles degenerate, the tendons shorten and a patient develops fixations of the joints known as "contractures." The shortened tendons cause joints to be pulled into unnatural positions, which make walking and everyday movement very difficult. For example, when the Achilles tendon (tendon at the back of the heel) shortens, the angle of the ankle joint changes so that the toes point toward the floor and the foot cannot be placed in a natural position for walking.

Contractures are prevalent in the Achilles tendons (in the ankle) and the knee flexors (hamstrings). Daily stretching can help postpone contractures and prolong the ability to walk. The daily regiment of stretching can be a tiresome and painful chore. It takes a tremendous amount of strength to counter the contractive force of the muscles and a tremendous amount of time to adequately stretch the muscles and tendons. Furthermore, a child who requires assistive stretching on a daily basis by either a therapist or a parent can find the experience to be repetitive and unpleasant. Thus, what is needed is an apparatus that assists a patient in stretching exercises.

Sports injuries such as a hamstring pull prevail throughout many athletic activities, affecting all walks of life, from the common weekend warrior to professional athletes. Stretching has always played an important role in the rehabilitative healing process. However, it is difficult for an individual to apply gradual, static stretch to the muscles such as the hamstring. Thus, what is needed is an apparatus that assists an individual in stretching exercises.

SUMMARY OF THE INVENTION

In one embodiment of the invention, a stretching apparatus includes a base comprising a seat, a back support mounted to the base, at least one leg support pivotally mounted to the base, a first strap securing a user's leg to the leg support, a foot pedal positioned at a free end of the leg support, and a second strap securing a user's heel to the leg support.

BRIEF DESCRIPTION OF THE DRAWINGS

FIG. 10 is a close-up perspective top view of the foot pedal in one embodiment of the invention.

FIG. 11 is a close-up perspective bottom view of the foot pedal in one embodiment of the invention.

FIG. 12 is a close-up perspective top view of the bottom of the sliding knee mechanism with the knee cushion and a pin in one embodiment of the invention.

FIG. 13 is a close-up perspective bottom view of the sliding knee mechanism with the knee cushion and a pin in one embodiment of the invention.

FIG. 17 is a perspective view of the device folded up for transit or storage in one embodiment of the invention.

FIG. 18 is a perspective view of the device tipped up onto its wheels in one embodiment of the invention.

FIG. 19 is a perspective view of the stretching device with a user seated in one embodiment of the invention.

FIG. 20 is a close-up perspective view of a user's leg in the stretching device, showing the foot pedal, sliding foot and knee mechanisms in one embodiment of the invention.

FIG. 21 is a side view of the device with a seated user without raising the leg supports and the back support upright in one embodiment of the invention.

FIG. 22 is a side view of the device with a seated user partially raising one leg support and lowering the back support in one embodiment of the invention.

FIG. 23 is a side view of the device with a seated user, showing a further raised leg support and the back support fully lowered in one embodiment of the invention.

DETAILED DESCRIPTION

Figures 1, 2:
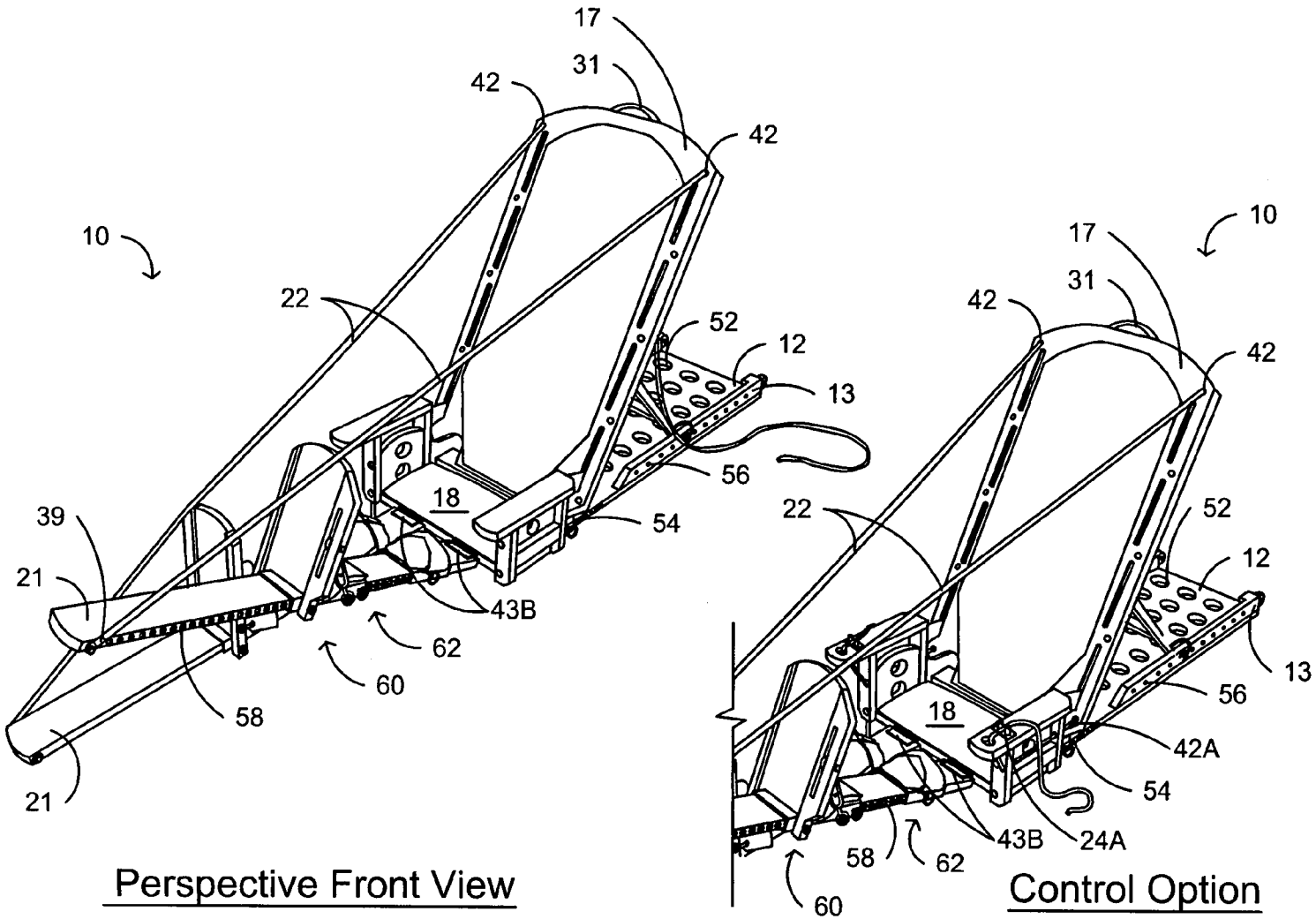
FIG. 1 is a perspective front view of the apparatus in one embodiment of the invention.
FIG. 2 is a perspective close-up view of the apparatus with controls mounted on the armrest in one embodiment of the invention.

In accordance with the invention, a stretching apparatus is provided to stretch the heel cord, the calf muscles, and the hamstring muscles plus the associated muscles, tendons, and joints in the legs, feet, ankles, and back. The stretching apparatus is adaptable, allowing the user and/or therapist to adjust the components to accommodate a range of body sizes. Adjustable locking armrests can be raised or lowered to fit the specific user. Adjustable locking foot pedals, adjustable locking knee pads, and an adjustable seat can adapt to various lengths of the user's legs. A back support can also be repositioned for the appropriate body size.

The stretching apparatus is comfortable and easy to manipulate, allowing the user and/or therapist to maintain control throughout the stretching session. The adjustable locking foot pedals can be angled and then locked into position to stretch the heel cord and the calf muscle. Adjustable locking back support and adjustable locking leg supports give the user full control to the degree and duration of a hamstring stretch. The stretching apparatus can also be adjusted during use as needed.

The user has the ability to use the apparatus to stretch both legs simultaneously or choose to isolate just one leg or ankle. The user may stretch the heel cord and the calf muscle of one or both legs independently without a hamstring stretch. Likewise, the user may stretch the hamstring muscle without greatly affecting the heel cord and the calf muscle. While the stretching apparatus does have the ability to isolate parts of the leg, it also has the ability to function in combination. The hamstrings, the heel cords, and the calf muscles of both legs can simultaneously be stretched at the same time.

The stretching apparatus folds up easily for storage or transport. The stretching apparatus can then be ready for use at home, office or gym.

When the user is a child, an adult supervisor can fasten or tie off the controls (e.g., ropes) away from the user. This will inhibit the child from lowering the leg supports before the predestined time of the stretch is over.

FIGS. 1, 2, 3, 4, and 5 show various views of a stretching apparatus 10 in one embodiment of the invention. Stretching apparatus 10 includes a base 12, a back support 17 pivotally attached to base 12, and two leg supports 21 pivotally attached to base 12. Base 12 includes a seat 18 at one end and wheels 11 (best shown in FIG. 3) attached at an opposite end. Holes 52 (best shown in FIG. 3) are provided in base 12 to reduce weight. In one embodiment, base 12, back support 17, and leg supports 21 are made of wood but other materials such as plastic and composites can also be used.

Figure 7:
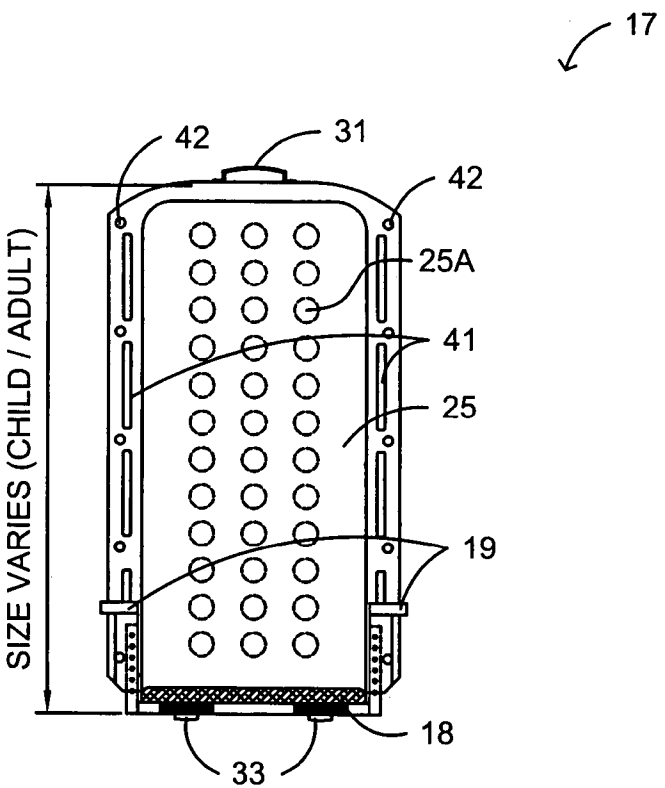
FIG. 7 is a close-up front view of the back support in one embodiment of the invention.
Figure 6:
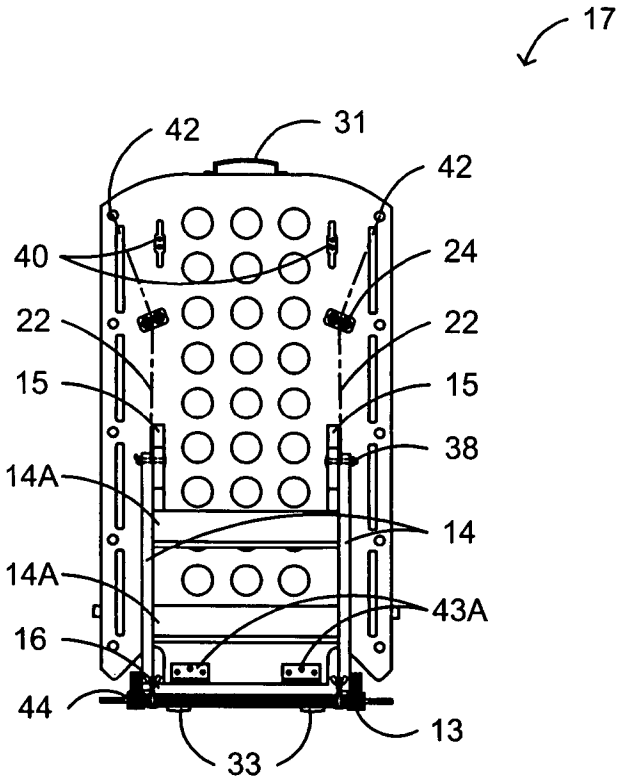
FIG. 6 is a close-up back view of the back support in one embodiment of the invention.
Figure 14:
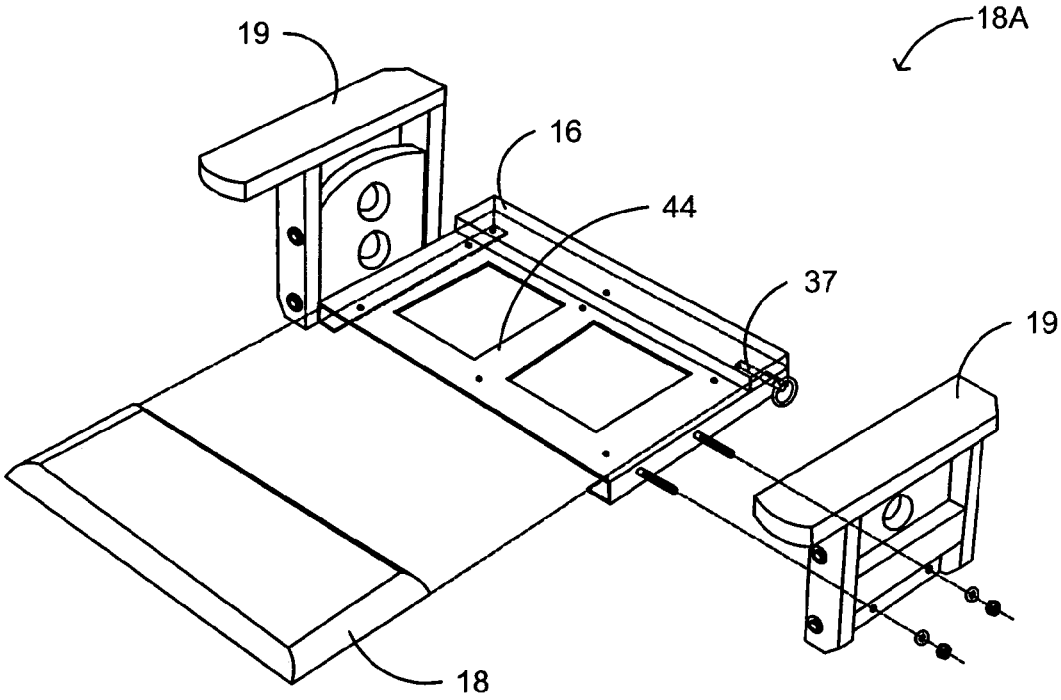
FIG. 14 is a close-up perspective front view of the sliding seat mechanism in one embodiment of the invention.

FIGS. 6, 7, and 14 show finther details of back support 17 and a sliding seat mechanism 18A in one embodiment of the invention. Back support 17 is pivotally attached to sliding seat mechanism 18A. Specifically, back support 17 is attached to a back support base 16 (also shown in FIGS. 3 and 4) by hinges 43A (also shown in FIG. 5). Back support base 16 and seat 18 are mounted onto a bracket 44 that fits around base 12. Bracket 44 can be made out a metal plate shaped to slide over base 12. Base 12 includes one or more rows of holes 54 (also shown in FIGS. 3 and 4) along its sides where one or more locking pins 37 can secure bracket 44 to base 12. This allows the location of back support 17 and sliding seat mechanism 18A to be slidably adjusted along base 12 for the user. Armrests 19 are mounted to the sides of bracket 44. Armrests 19 can be raised or lowered and then locked into position by nuts and bolts 19A (also show in FIG. 4). This allows each user to be seated comfortably in stretching apparatus 10. Alternatively, back support 17 can be pivotally attached to base 12 to provide a non-slidable back rest.

Figure 3:
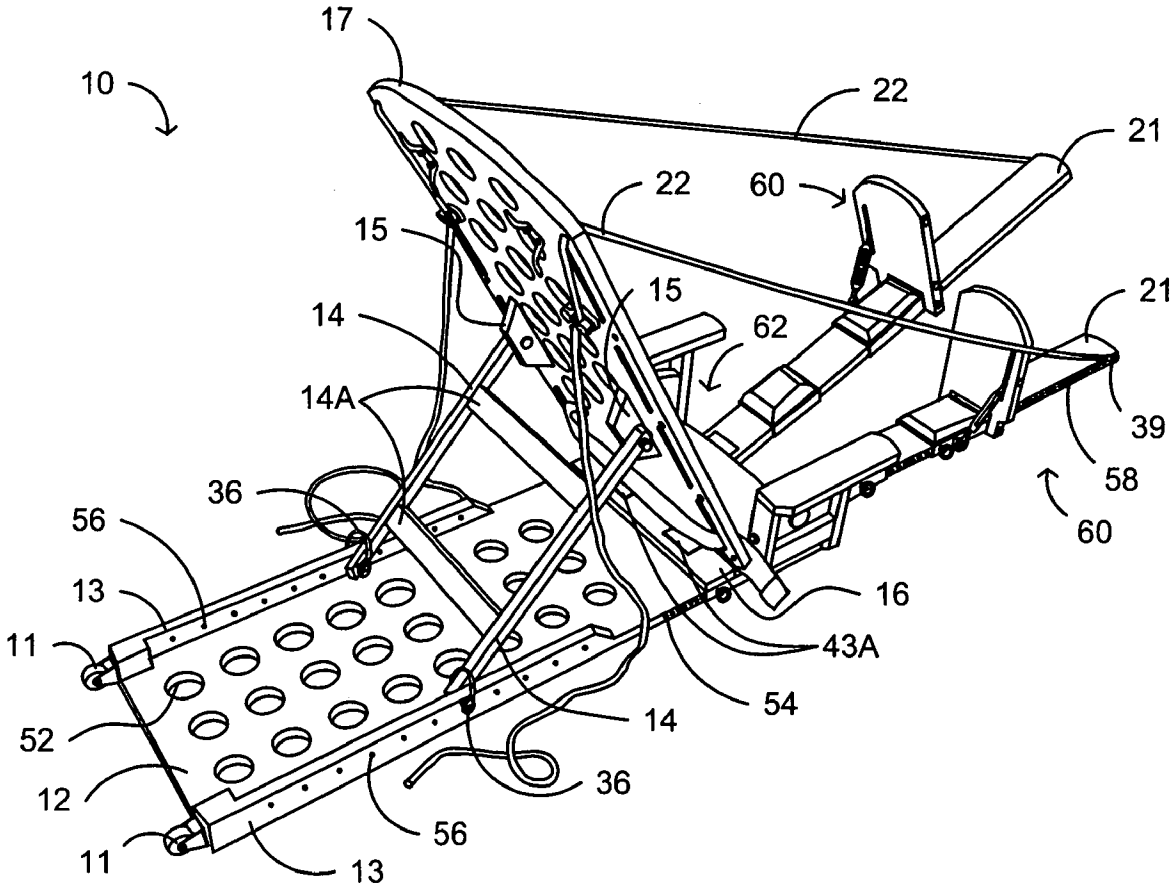
FIG. 3 is a perspective back view of the apparatus in one embodiment of the invention.
Figure 4:
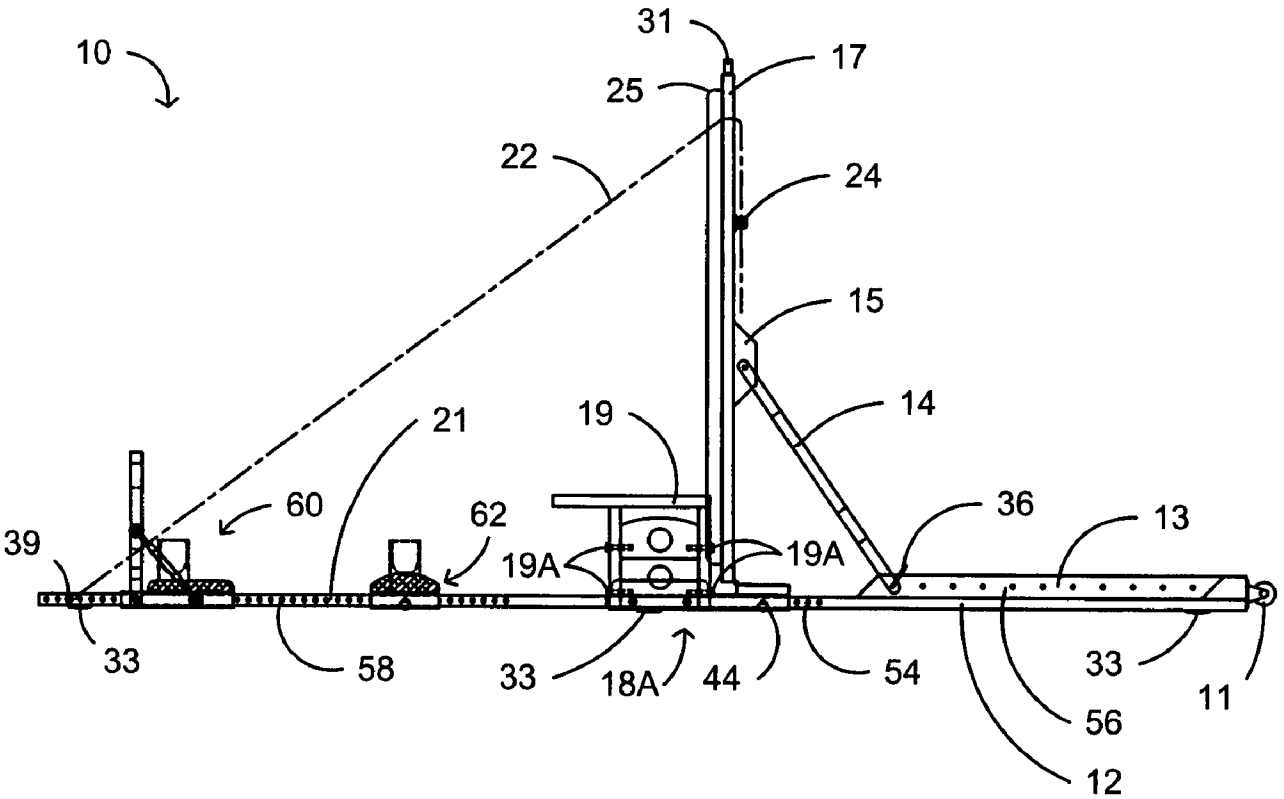
FIG. 4 is a side view of the apparatus with back support and foot pedals fully erect in one embodiment of the invention.
Figure 5:
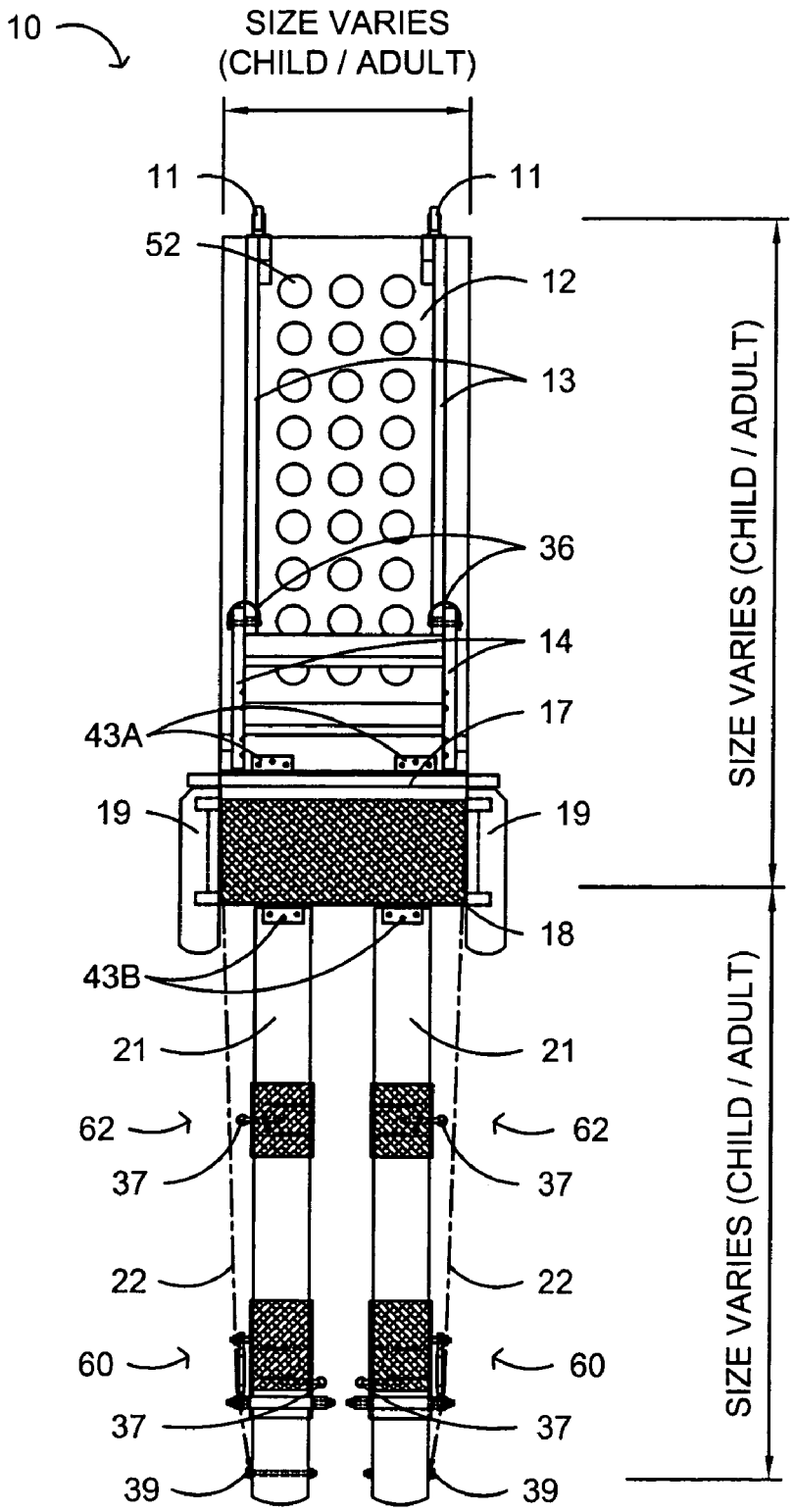
FIG. 5 is a plan view of the stretching device with leg supports fully lowered and back support fully raised in one embodiment of the invention.

Mounted on the backside of back support 17 are two back support arms brackets 15 (also shown in FIGS. 3 and 4). The top ends of two back support arms 14 are pivotally mounted to brackets 15 by nuts and bolts 38. The bottom ends of arms 14 are next secured to two back support rails 13 (also shown in FIGS. 3 and 4) mounted on base 12 behind back support 17. Arms 14 are interconnected by crossbeams 14A (also shown in FIG. 3). Each back support rail 13 has a row of holes 56 (also shown in FIGS. 3 and 4) where arms 14 can be secured by a locking U-pin 36 (also shown in FIGS. 3 and 4). This allows the inclination of back support 17 to be adjusted for the user and for different stretching exercises.

Slots 41 (FIG. 7) are provided near the right and left edges of back support 17. Slots 41 can receive chest, head, and lumbar support straps. Two guide holes 42 are provided near the top of the right and left edges to receive two ropes 22 used to elevate leg supports 21 (described later). Holes 25A are provided in back support 17 to reduce the weight. A back support cushion 25 is mounted on the front side of back support 17 for added comfort. A handle 31 is mounted at the top of back support 17.

Ropes 22 are fed from the front to the back of back support 17 through guide holes 42. Ropes 22 are secured by corresponding cam-cleat locking devices 24 (FIG. 6) on the backside of back support 17 to the desired lengths. Additionally, cleats 40 (FIG. 6) are provided on the backside for another way to secure ropes 22 or to tie off excessive lengths.

Figure 15:
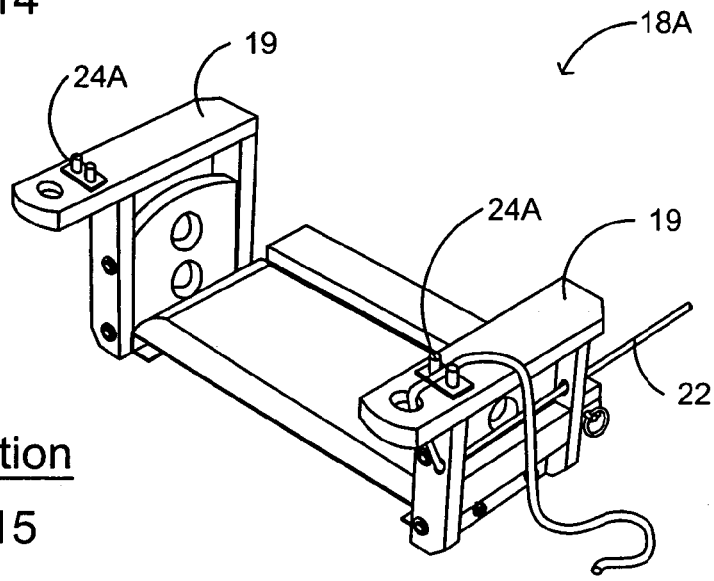
FIG. 15 is a close-up perspective front view of the sliding seat mechanism with control features on the armrest in one embodiment of the invention.

FIGS. 2 and 15 illustrate an alternative configuration to secure ropes 22 in one embodiment. Ropes 22 are routed downward from holes 42 on the backside of back support 17 and exit through holes 42A to the front of back support 17. Ropes 22 are then routed through the frame of armrest 19 to the top of armrests 19. Cam-cleat locking devices 24A are mounted on the top of armrests 19 to secure ropes 22 to the desired length. In this configuration, the user can manipulate the stretching without assistance.

Figure 8:
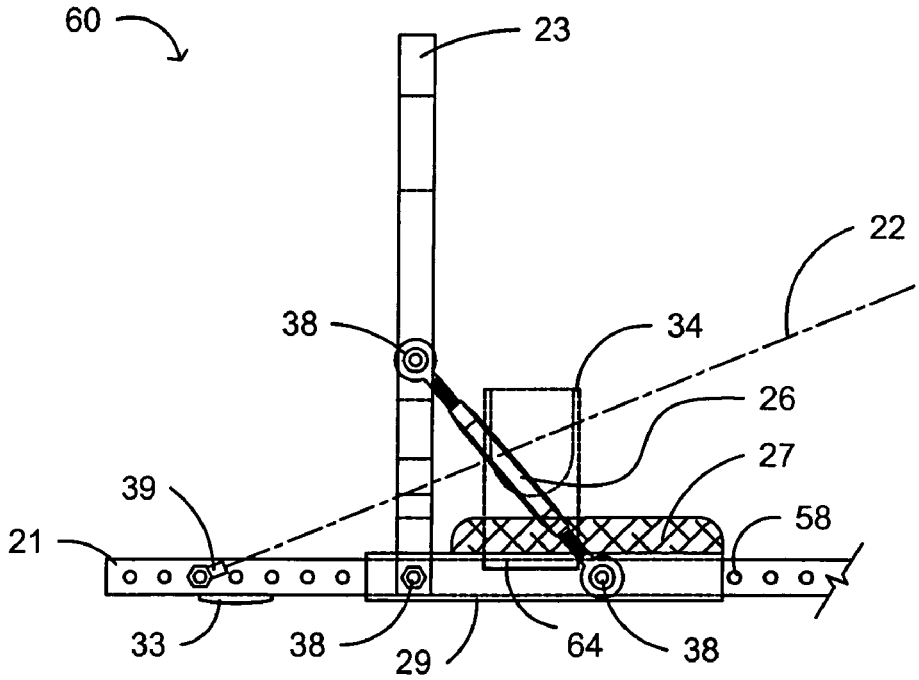
FIG. 8 is a close-up side view of the foot pedal in one embodiment of the invention.
Figure 9:
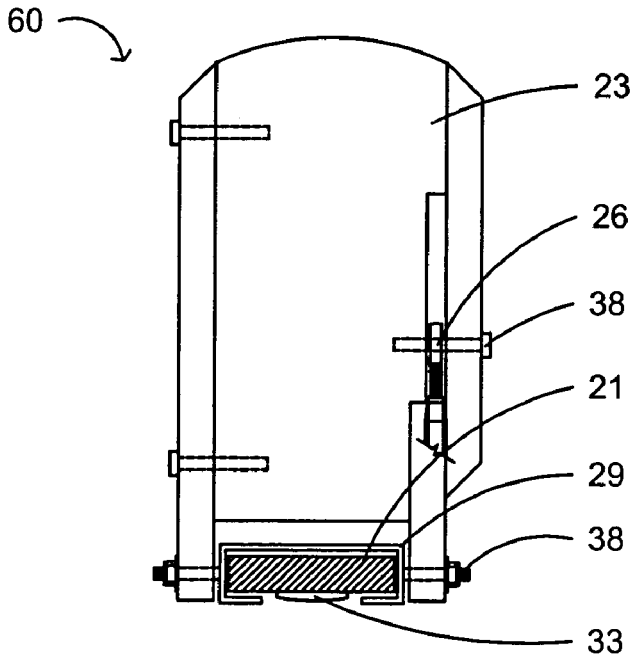
FIG. 9 is a close-up front view of the foot pedal in one embodiment of the invention.

Referring back to FIGS. 1 to 5, leg supports 21 are pivotally attached to base 12 by hinges 43B (best shown in FIG. 5). This allows the free ends of leg supports 21 to be raised upward. One rope 22 is fixed to the free end of each leg support 21 by a metallic clasp 39 (also shown in FIG. 8). As described above, ropes 22 run through guide holes 42 (FIGS. 6 and 7) on back support 17 and are secured by cam-cleats 24 (FIG. 7) on the backside of back support 17 at the desired lengths. This allows the inclination of each leg support 21 to be adjusted for different stretching exercises.

Non-scratch pads 33 can be mounted underneath leg supports 21 and base 12 (best shown in FIG. 4). Each leg support 21 includes a row of holes 58 for accepting locking pins 37 (best shown in FIG. 5). Each leg support 21 receives a sliding foot mechanism 60 and a sliding knee mechanism 62 that are secured by locking pins 37.

FIGS. 8, 9, 10, and 11 show further details of sliding foot mechanism 60 in one embodiment of the invention. Mechanism 60 includes a bracket 29 that fits around leg support 21, and a foot pedal 23 that is pivotally attached to bracket 29 by nuts and bolts 38. Bracket 29 can be made out a metal plate shaped to slide over leg support 21. Bracket 29 allows the position of mechanism 60 to be slidably adjusted along leg support 21. A locking pin 37 (FIG. 11) is passed through a hole in bracket 29 and one of the holes 58 positioned on the side of leg support 21 to lock mechanism 60 in place.

A free end of foot pedal 23 is linked by a turnbuckle 26 to bracket 29. The ends of turnbuckle 26 are attached to foot pedal 23 and bracket 29 by nuts and bolts 38. The inclination of foot pedal 23 relative to leg support 21 is adjusted by turning turnbuckle 26. This allows the inclination of each foot pedal 23 to be adjusted for different stretching exercises.

Mechanism 60 includes a foot strap 34 (e.g., a hook-and-loop type) that secures a user's heel against leg support 21 and a user's foot against foot pedal 23 during use. Foot strap 34 is looped through slots 64 in bracket 29. A heel cushion 27 is mounted on the top of bracket 29 for added comfort. Heel cushion 27 is attached to bracket 29 by screws mounted through holes on the bottom of bracket 29.

FIGS. 12 and 13 show further details of sliding knee mechanism 62 in one embodiment of the invention. Mechanism 62 includes a bracket 30 that fits around leg support 21, and a knee strap 20 (e.g., a hook-and-loop type) that loops through slots 66 in bracket 30. Bracket 30 can be made out a metal plate shaped to slide over leg support 21. Bracket 30 allows the position of mechanism 62 to be slidably adjusted along leg support 21. A locking pin 37 (FIGS. 5 and 13) is passed through a hole in bracket 30 and one of the holes 58 positioned on the side of leg support 21 to lock mechanism 62 in place. A knee cushion 28 is mounted on top of bracket 30 for added comfort. Knee cushion 28 is attached to bracket 30 by screws mounted through holes on the bottom of bracket 30. Mechanism 62 is typically positioned behind a user's knee. Strap 20 secures the user's leg against leg support 21 to hold the user's leg in place during use.

Figure 16:
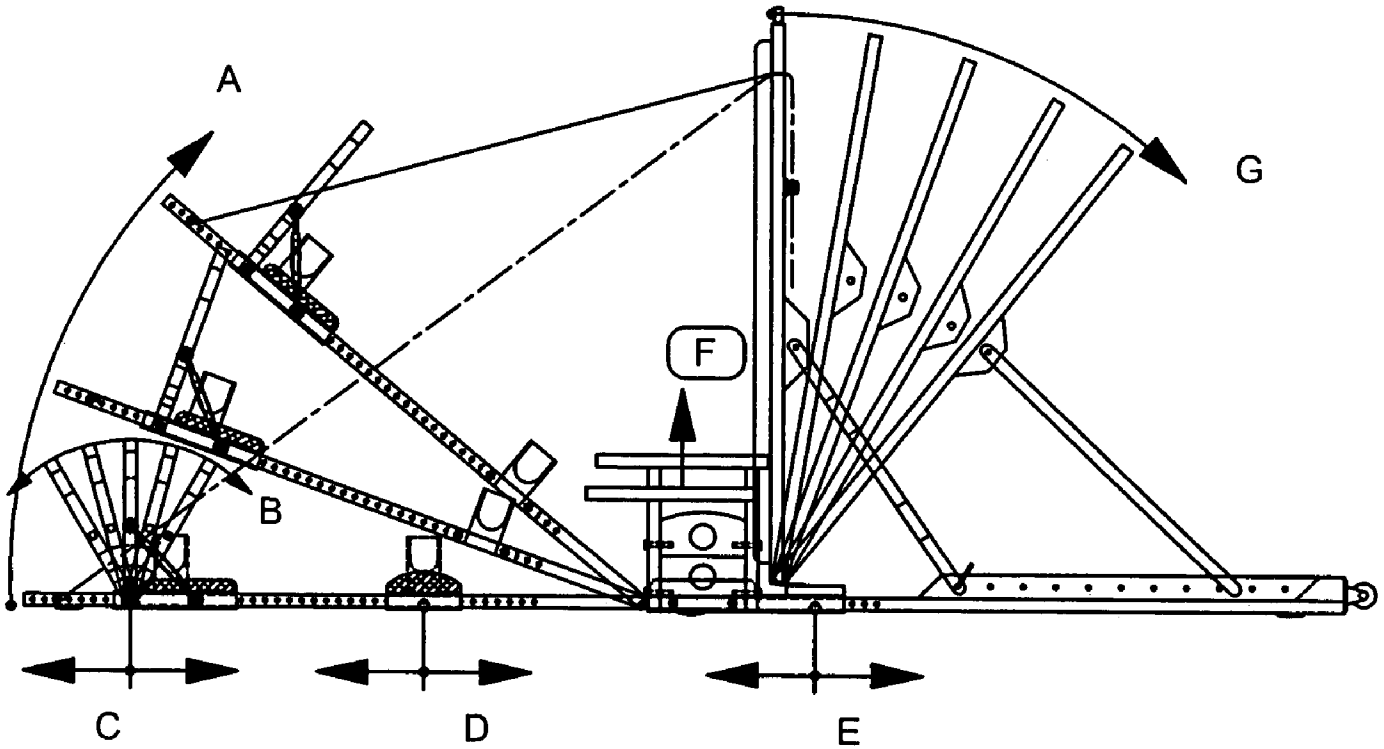
FIG. 16 is a side view of the stretching machine indicating varying ranges of motion in one embodiment of the invention.

FIG. 16 shows the various ranges of motion of stretching apparatus 10 in one embodiment of the invention. Motion A illustrates the range that leg supports 21 can be raised. Rope 22 is pulled taunt to raise leg supports 21. Motion B illustrates the range that foot pedals 23 can be positioned on leg supports 21. Motion C illustrates the range that sliding foot mechanism 60 can be positioned along leg support 21. Motion D illustrates the range that sliding knee mechanism 62 can be positioned along leg support 21. Motion E illustrates the range that back support 17 and sliding seat mechanism 18A can be positioned along base 12. Motion F illustrates the range that armrests 19 can be raised or lowered. Motion G illustrates the range that back support 17 can be inclined.

FIG. 17 is a perspective view of stretching apparatus 10 folded up for transit or storage in one embodiment of the invention. Back support 17 is collapsed with back support arms 14 (not visible) detached from back support rails 13 (not visible). Leg supports 21 are also folded down onto base 12. With ropes 22 pulled taunt, leg supports 21 are fully raised. Ropes 22 are then secured behind back support 17 by either the cam-cleats 24 or cleats 40 (not visible). Extra lengths of ropes 22 can be used to further tie up the components. Thus, stretching apparatus 10 is in a fully collapsed position ready for transit or storage.

FIG. 18 is a perspective view of stretching apparatus 10 in a temporary moving position in one embodiment of the invention. In a semi-collapsed position, the user can use handle 31 to tip up stretching apparatus 10 so that the weight of the apparatus is on wheels 11. This allows one to roll stretching apparatus 10 on wheels 11 with ease into another room or location.

FIG. 19 is a perspective view of stretching apparatus 10 with a user 68 seated and strapped in. User 68 is secured onto the device by a chest strap 41, knee straps 20, and foot straps 34. FIG. 20 is a close-up perspective view of the user's leg in stretching apparatus 10, showing leg support 21, sliding foot mechanism 60, and sliding knee mechanism 62. The user's heel rests comfortably on heel cushion 27. Foot strap 34 holds the user's heel against leg support 21 and the user's foot against foot pedal 23. The user's leg rests comfortable on knee cushion 28. Knee strap 20 holds the leg in position against leg support 21. Sliding foot mechanism 60 and sliding knee mechanism 62 are each secured to leg support 21 by locking pins 37 (only one is visible).

FIG. 21 is a side view of stretching apparatus 10 with a seated user shown without raising the leg supports 21 in a pre-stretch position. The user is secured onto the device by knee straps 20 and foot straps 34.

FIG. 22 is a side view of stretching apparatus 10 with a seated user partially raising one leg support 21 and lowering the back support 17. The user is secured onto the device by knee straps 20 and foot straps 34. As can be seen, the user is in an upright position that allows him to watch a television program, play a game, and/or enjoy a snack during the stretching exercise. This feature distracts the user from the stretching exercise and allows the user to endure longer stretching sessions.

FIG. 23 is a side view of stretching apparatus 10 with a seated user, showing a farther raised leg support 21 and a fully lowered back support 17. The user is secured onto the device by knee straps 20 and foot straps 34.

Operation

Prior to using the invention, the user or assistant would adjust back support 17 and foot pedals 23 to their proper positions, effectively locking them into place. Next the user would sit comfortably on seat 18 and lay his legs on leg supports 21 with feet placed on foot pedals 23. Knee straps 20 would then be wrapped around the legs at the knees and fastened to secure the legs to leg supports 21. Foot straps 34 would then be wrapped around the feet and fastened to secure the feet to foot pedals 23. The user or assistant would then adjust the angles of foot pedals 23 to begin stretching the heel cord and the calf muscle. The user or assistant would be able to use the leverage of foot pedals 23 to achieve the desired stretch angle without great strength and maintain a long stretching session by locking in the desired stretch angle with tumbuckle 26.

The user or assistant would next begin to stretch the hamstring by pulling one or both ropes 22 attached to the free ends of leg supports 21 to raise one or both legs upward. The angle of back support 17 relative to leg supports 21 creates the hamstring stretch for the user. Ropes 22 would then be locked tight with cam-cleats 24 to hold the legs still for a long stretching session. Ropes 22 can be pulled or loosened to adjust the intensity of the stretch. Back support or foot pedal angles can also be readjusted. The user would sit on the apparatus for a predetermined amount of time as prescribed by a physician or therapist. The user or assistant can also use stretching apparatus 10 to perform both the heel cord/calf muscle stretch and the hamstring stretch simultaneously.

A hamstring stretch can be combined with a calf stretch. The angle of back support 17 relative to leg supports 21 also creates a calf stretch if the position of sliding foot mechanisms 60 are fixed and the angles of foot pedals 23 are locked so that the user's feet push against foot pedals 23 as leg supports 21 are raised. If the user wishes to stretch the hamstring without stretching the calf, then the position of sliding foot mechanism 60 and/or the angle of foot pedals 23 are unlocked.

Advantages

From the description above, the following advantages of stretching apparatus 10 are evident:

(a) An adjustable, padded back support working in conjunction with a pair of adjustable leg supports creates the angle of stretch for the hamstrings.

(b) Leg supports are independent of each other to allow the user to stretch one or both legs.

(c) Padded foot pedals are adjustable along the leg support to accommodate various leg lengths and sizes.

(d) A pair of adjustable foot pedals in conjunction with the leg supports creates the angle of stretch for the hamstrings and the heel cords.

(e) Foot pedals are independent of each other allowing the user to stretch one or both heel cords.

(f) The stretching apparatus provides a safe non-bounding (non-bouncing) stretch of the leg muscles, specifically the hamstring muscles.

(g) It is an affordable and relatively simple device ready for public use.

(h) The invention is easy and convenient to operate.

(i) The invention is easy and convenient to transport, store, and set up.

(j) The invention enables the user to perform a long and stable stretch. Without the invention, a therapist or a parent can only hold each stretch for a short duration.

CONCLUSION

Stretching apparatus 10 is a greatly needed and beneficial tool in the battle against Duchenne muscular dystrophy and other similar neuromuscular diseases. The inventor believes that his son, Coby Yamauchi, has benefited greatly from the use and testing of stretching apparatus 10. Some doctors have suggested cutting his heel cord to relieve the intense pressure on his Achilles tendons instead of enduring the daily pain of stretching. Such a procedure would leave Coby powerless to ever walk again. The only other choice to retain the ability to walk is stretching the muscles and tendons.

The daily regiment of stretching can be a tiresome and painful chore. It takes both tremendous amount of strength and time to counter the contractive force of his muscles and to adequately stretch the muscles and tendons. Stretching apparatus 10 handles both of these requirements. Stretching apparatus 10 is able to counter the contractive forces with ease using the leverage provided by the foot pedal and the leg support. Stretching apparatus 10 is able to provide a long and stable stretch by securing the ropes that set the angle of the leg supports and locking the turnbuckles that set the angle of the foot pedals. This would otherwise not be possible because a therapist or a parent can only hold each stretch for a short duration.

Stretching apparatus 10 has allowed Coby to endure prolonged stretching sessions. While seated in stretching apparatus 10, he can be distracted from the agony of the stretching session by enjoying activities such as watching television, playing games, and/or eating a snack or dessert. The inventor believes that stretching apparatus 10 is an invaluable asset for helping Coby to retain flexibility in his legs and will undoubtedly help others with similar neuromuscular disorders.

Stretching apparatus 10 is also an easy and convenient apparatus to use at home, office or gym for sports injuries. Sports injuries such as a hamstring pull prevail throughout many athletic activities, affecting all walks of life, from the common weekend warrior to professional athletes. Stretching has always played an important role in the rehabilitative healing process. Although there are methods available to the layman and therapist, there is no other device, in regards to stretching the leg muscles, with the capabilities of stretching apparatus 10. The injured user would use stretching apparatus 10 to strengthen the leg while increasing flexibility as a preventative measure against re-injury.

The muscles should be stretched properly to avoid injury during the stretching exercise itself. The ideal condition for a stretch is when the muscles are relaxed thereby allowing for greater range of motion. The stretch should be in a stable non-bounding (non-bouncing) action to minimize the likelihood of a muscle pull or other injury.

Various other adaptations and combinations of features of the embodiments disclosed are within the scope of the invention. Future options may include more padding, more hook-and-loop fastener straps, or a textured surface for the device. Additionally, the invention may be composed of a lighter and/or stronger material. Also, indicators for angles of stretch, a digital clock with timer, a steering wheel or controls for a child's entertainment, a heat therapy pack for use behind the knee or on the area to be stretched, a table top with cup holder can be attached to the armrests or base. Body straps, a lumbar back support, and a head support may be added for additional support. Instead of guiding holes in the back support, pulleys can be used to create less friction on the ropes as they pass through the back support. Numerous embodiments are encompassed by the following claims.

What is claimed is:

1. A stretching apparatus, comprising:
- a base;
- a back support mounted to the base;
- at least one leg support pivotally mounted to the base, the leg support providing a single rigid surface for supporting an entire leg;
- a sliding foot pedal mechanism, comprising:
  - a first bracket slidably mounted along the leg support;
  - a foot pedal pivotally mounted to the first bracket;
  - a fastener linking a free end of the foot pedal to the first bracket, wherein an inclination of the foot pedal is varied by adjusting the fastener.

2. The apparatus of claim 1, wherein the fastener is a turnbuckle.

3. The apparatus of claim 1, wherein the first bracket defines a hole and the leg support defines a plurality of holes along its length, the first bracket being secured to a position along the leg support by a pin inserted in the hole of the first bracket and one of the holes of the leg support.

4. The apparatus of claim 1, wherein the first bracket further (1) comprises a heel cushion upon which the user's heel rests and (2) defines slots for receiving a strap, the strap securing a user's heel to the leg support, thereby pushing a user's foot against the foot pedal.

5. A stretching apparatus, comprising:
- a base;
- a back support mounted to the base;
- at least one leg support pivotally mounted to the base;
- a sliding foot pedal mechanism, comprising:
  - a bracket slidably mounted along the leg support;
  - a foot pedal pivotally mounted to the bracket;
  - a fastener linking a free end of the foot pedal to the bracket, wherein an inclination of the foot pedal is varied by adjusting the fastener;
- a cord having:
  - a first end secured to a free end of the leg support; and
  - a second end fed through a guide hole in the back support and secured to a fixture mounted on the back support, wherein an inclination of the leg support is fixed by the cord.

6. The apparatus of claim 5, wherein the fixture is selected from the group consisting of a cam-cleat and a cleat.

7. The apparatus of claim 5, wherein the fixture is a cam-cleat, the apparatus further comprising a cleat for tying up extra length of the cord.

8. The apparatus of claim 1, wherein the back support is pivotally mounted to the base.

9. A stretching apparatus, comprising:
- a base;
- at least one leg support pivotally mounted to the base;
- a foot pedal positioned at a free end of the leg support;
- a sliding seat mechanism, comprising:
  - a first bracket slidably mounted to the base;
  - a seat mounted to the first bracket; and
  - a back support pivotally mounted to the first bracket.

10. The apparatus of claim 9, wherein:
- the base further comprises at least a rail defining a plurality of holes along its length;
- the back support further comprises at least one arm bracket and at least one arm, the arm having (1) a first end pivotally mounted to the arm bracket and (2) a second end secured with a pin to one of the holes in the rail.

11. The apparatus of claim 9, wherein the back support comprises slots along two edges to accommodate straps for stabilizing the user.

12. A stretching apparatus, comprising:

a base;

a back support mounted to the base;

at least one leg support pivotally mounted to the base, the leg support defining a plurality of holes along its length;

a foot pedal positioned at a free end of the leg support; and a sliding knee mechanism, comprising:

a first bracket slidably mounted along the leg support, the first bracket defining slots for receiving a strap and a hole for receiving a pin, wherein the first bracket is secured to a position along the leg support by the pin inserted in the hole of the first bracket and one of the holes of the leg support;

a knee cushion mounted to the first bracket, wherein the strap secures a user's knee to the leg support.

13. The apparatus of claim 9, farther comprising height-adjustable armrests mounted to the first bracket.

14. The apparatus of claim 9, further comprising a handle on the back support, wherein the handle is used to transport the apparatus when the leg support and the back support are collapsed onto the base.

15. The apparatus of claim 9, further comprising:

the seat having at least one armrest;

a cord having:

a first end secured to a free end of the leg support; and a second end fed through a guide hole in the back support, routed down a backside of back support, exited through a second guide hole, and secured to a fixture mounted on the armrest;

wherein an inclination of the leg support is fixed by the cord.

16. The apparatus of claim 9, further comprising:

a first strap securing a user's leg to the leg support; and a second strap securing a user's heel to the leg support, thereby pushing a user's foot against the foot pedal.

17. The apparatus of claim 9, further comprising at least one wheel attached to the base, wherein the apparatus is transported by rolling the apparatus on the wheel.

18. The apparatus of claim 9, wherein the first bracket defines a hole and the base defines a plurality of holes along its length, the first bracket being seared to a position along the base by a pin inserted in the hole of the first bracket and one of the holes of the base

19. The apparatus of claim 1, further comprising:

a second bracket slidably mounted along the leg support, the second bracket defining slots for receiving a strap;

a knee cushion mounted to the second bracket, wherein the strap secures a user's knee to the leg support.

20. The apparatus of claim 19, further comprising:

a third bracket slidably mounted to the base, wherein the back support is pivotally mounted to the third bracket; and a seat mounted to the third bracket.

21. The apparatus of claim 20, wherein the back support comprises slots along two edges to accommodate straps for stabilizing the user.

22. The apparatus of claim 21, further comprising:

a handle on the back support;

at least one wheel attached to the base, wherein the handle and the wheel are used to transport the apparatus when the leg support and the back support are collapsed onto the base.

23. The apparatus of claim 9, further comprising:

a second bracket slidably mounted along the leg support, the second bracket defining slots for receiving a strap, a heel cushion mounted to the second bracket upon which the user's heel rests;

a foot pedal pivotally mounted to the second bracket;

a fastener linking a free end of the foot pedal to the second bracket, wherein an inclination of the foot pedal is varied by adjusting the fastener and the strap secures a user's heel to the leg support, thereby pushing a user's foot against the foot pedal.

24. The apparatus of claim 9, further comprising:

a cord having:

a first end secured to a free end of the leg support; and a second end fed through a guide hole in the back support and secured to a fixture mounted on the back support;

wherein an inclination of the leg support is fixed by the cord.

25. The apparatus of claim 12, further comprising:

a cord having:

a first end secured to a free end of the leg support; and a second end fed through a guide hole in the back support and secured to a fixture mounted on the back support;

wherein an inclination of the leg support is fixed by the cord.

26. The apparatus of claim 25, wherein the back support is pivotally mounted to the base.

27. The apparatus of claim 26, further comprising:

a handle on the back support;

at least one wheel attached to the base, wherein the handle and the wheel are used to transport the apparatus when the leg support and the back support are collapsed onto the base.

* * * * *